US005181302A

United States Patent [19]

Evans

[11] Patent Number: 5,181,302

[45] Date of Patent: Jan. 26, 1993

[54] DIE CONSTRUCTION FOR CLIPPER MECHANISM

[75] Inventor: Alfred J. Evans, Raleigh, N.C.

[73] Assignee: Delaware Capital Formation, Inc., Apex, N.C.

[21] Appl. No.: 564,137

[22] Filed: Aug. 7, 1990

Related U.S. Application Data

[63] Continuation of Ser. No. 418,983, Oct. 6, 1989, abandoned, which is a continuation of Ser. No. 258,799, Oct. 17, 1988, abandoned.

[51] Int. Cl.[5] ..... B23P 11/00

[52] U.S. Cl. ..... 29/243.56; 72/482

[58] Field of Search ..... 29/243.56, 243.57, 243.5; 227/155; 72/465, 482

[56] References Cited

U.S. PATENT DOCUMENTS 2,438,837 11/1944 Archer ..... 72/465
4,458,402 7/1984 Evans ..... 29/243.56
4,509,358 4/1985 Krowl ..... 72/465

*Primary Examiner*—J. J. Swann
*Attorney, Agent, or Firm*—Allegretti & Witcoff, Ltd.

[57] ABSTRACT

A clipper mechanism which is utilized to form U-shaped clips about gathered material embodies a receiving die mounted on an elastic material to compensate for variations in the cross sectional area about which the clip is applied.

6 Claims, 1 Drawing Sheet

DIE CONSTRUCTION FOR CLIPPER MECHANISM

This application is a continuation of application Ser. No. 07/418,983, filed Oct. 6, 1989, which is a continuation of Ser. No. 07/258,799, filed Oct. 17, 1988, both now abandoned.

BACKGROUND OF THE INVENTION

This invention relates to an improved mechanism for attaching U-shaped clips about gathered material and more particularly to the improvement in single and double clipping mechanisms of a die block assembly having an elastically responsive characteristic.

One method of processing of comminuted meat or cheese products includes stuffing the product in a casing material and forming U-shaped metal clips about portions of gathered casing material at spaced intervals. U.S. Pat. No. 3,400,433 issued Sep. 10, 1968 entitled "Clipping Device" in the name of Klenz, describes a typical clip U.S. Pat. No. 4,004,339 issued Jan. 25, 1977 entitled "Single Piston Operated Clip Device" and reissued Jan. 22, 1980 as U.S. Pat. No. Re 30,196 in the name of Velarde, describes a typical device for fastening such clips about casing material. The clipping operation often includes simultaneously applying two clips to a portion of gathered material by a single piston operated mechanism as described in U.S. Pat. No. 4,001,926 issued Jan. 11, 1977 entitled "Double Clipper, Single Piston Operated Device" in the name of Velarde. Fastening straps may also be clipped to the gathered casing material in order to facilitate further processing of the product as described in U.S. Pat. No. 4,227,668 issued Oct. 14, 1980 entitled "Hanger Member" in the name of Ernst.

Variations in both the clipper mechanism component tolerances and the cross sectional area to be circumscribed by the clip affect the adequacy of attachment of the clip about the gathered material. A clip applied too tightly may impart undue pressure to the gathered casing material causing the fibers of the casing material to fracture. Conversely, a too loosely applied clip may slip off the casing material. To compensate for such circumstances, applicant provides means for adjusting the position of a die block which is engaged by a clip in response to driving forces imparted by a fixed stroke reciprocating punch as described in U.S. Pat. No. 4,458,402 issued Jul. 10, 1984 entitled "Adjustable Crimping Die for Clipper Mechanism". U.S. Pat. No. 4,458,402 employs a die block assembly that requires manual operation to adjust the position of the die block. The die block assembly compensates for variations in the cross sectional area about which the clip is applied and for component tolerances in the clipper mechanism. Variations in the cross sectional area about which the clip is applied may result from variations in gathered material bulk and/or from the addition of a fastening strap to the gathered material.

The present invention contemplates a construction which automatically and dynamically overcomes the problems noted with respect to manual repositioning of the die block to compensate for variations in the cross sectional area about which a clip is applied.

SUMMARY OF THE INVENTION

Briefly, the present invention comprises a clipper mechanism having a unique and improved die block assembly for forming a clip about gathered material in cooperation with a fixed stroke reciprocating punch. The die block assembly dynamically adjusts the position of a die block during formation of the clip about gathered material to compensate for variations in the cross sectional area about which the clip is applied. The die block adjusts dynamically by means of an elastic material seated at the base of a die retaining counterbore.

Thus, it is an object of the present invention to provide an improved clipper apparatus which includes a self adjusting die block assembly cooperative with a punch for forming a U-shaped clip about gathered material.

Another object of the present invention is to provide an economical construction for a self adjusting die block assembly cooperative with a punch for forming a U-shaped clip about gathered material.

A further object of the present invention is to provide a mechanically reliable die block assembly cooperative with a punch for forming a U-shaped clip about gathered material.

A still further object of the present invention is to provide an interchangeable self adjusting die block assembly for facilitating an expedient retrofit of die block assemblies in existing clipper mechanisms.

These and other objects, advantages and features of the invention will be set forth in the detailed description which follows.

BRIEF DESCRIPTION OF THE DRAWINGS

In the detailed description of the invention, reference will be made to the drawing comprised of the following figures.

DESCRIPTION OF THE PREFERRED EMBODIMENT

Figure 1:
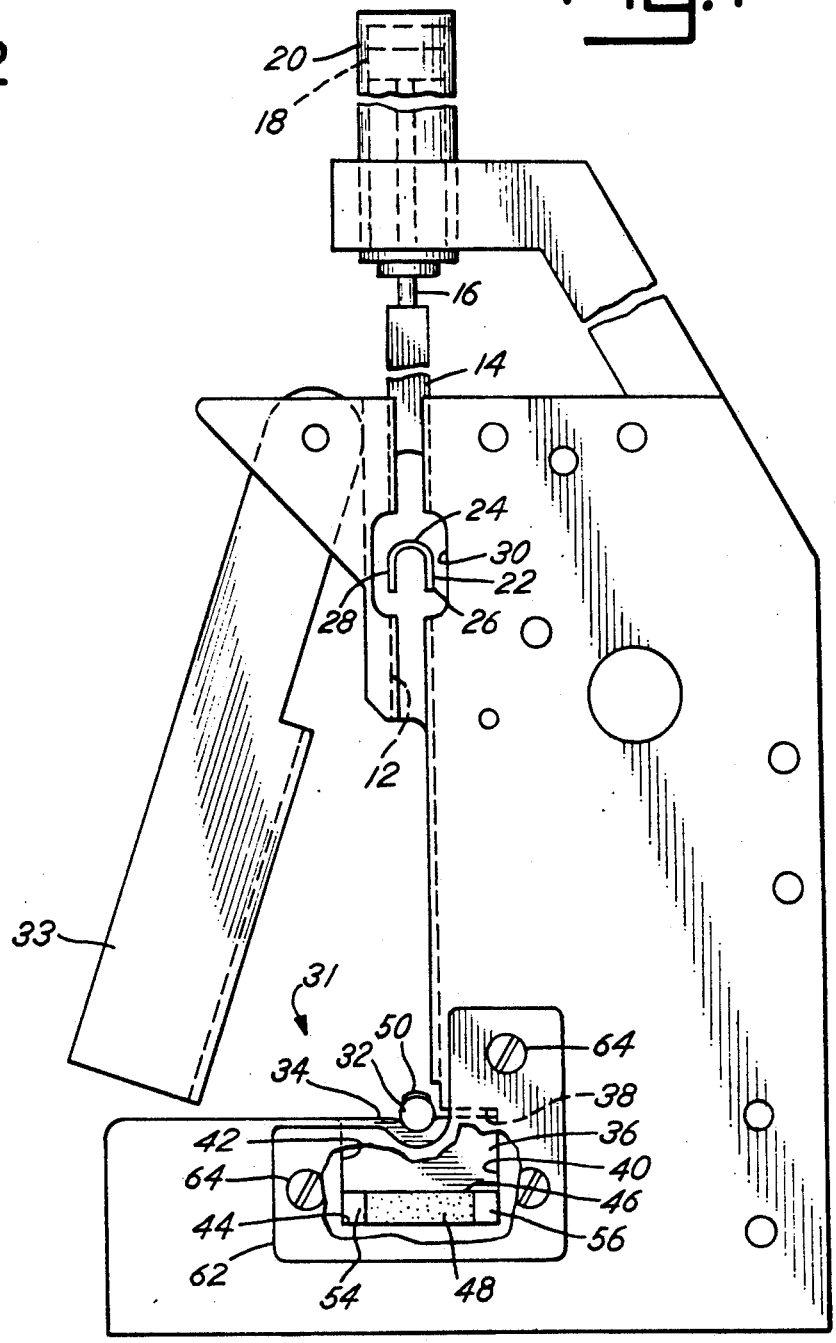
FIG. 1 is side elevation sectional view of a clipper mechanism incorporating the improved die block assembly of the present invention.

As shown in FIG. 1, a typical clipper of the type which may incorporate the subject matter of the present invention includes a C-shaped mounting plate 10 which includes a channel for receipt of a reciprocating punch 14. Typically punch 14 is driven by a depending drive rod 16 associated with a piston 18 incorporated in a cylinder 20 mounted on plate 10. Thus, punch 14 will reciprocate in response to the operation of piston 18.

Punch 14 is fashioned to engage a U-shaped clip 22 having a crown 24 and two depending legs 26 and 28. Clip 22 fits into a channel 12 through a channel opening or feed 30, is engaged by punch 14 and driven downwardly through channel 12. Gathered material 32 is inserted through a throat 31 defined by plate 10 and retained by a swinging gate 33. Gate 33 and plate 10 define the channel 12 so that legs 26 and 28 of clip 22 will fit on each side of gathered material 32. As punch 14 descends, it causes the free end of each leg 26 and 28 to engage with a spiral groove 34 formed in the active surface of a die block 36 at the lower end of channel 12 and thus form clip 22 about gathered material 32.

Figure 2:
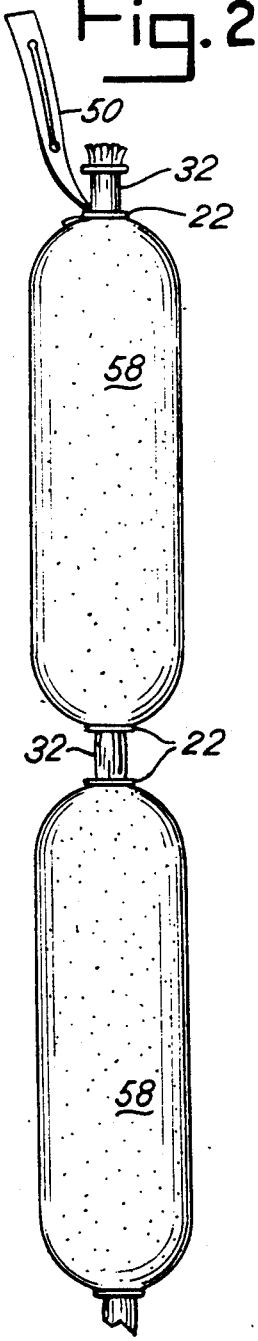
FIG. 2 is a plan view of a fastening strap clipped to a single link in a string of links separated by clips applied about gathered material.

FIG. 2 shows several clips 22 applied about gathered material 32 forming links 58. FIG. 2 also shows fastening strap 50 clipped to gathered material 32 by clip 22.

The structure so far described is typical of a clipper mechanism which is utilized to form U-shaped clips about gathered material. Typically, more than one clip 22 may be formed about the gathered material by arranging plural punches and dies in a side by side array wherein fixed stroke punches are generally driven by a single piston.

The present invention relates to the combination of an improved die block assembly as incorporated with a single or plural clipper mechanism. Specifically, die block 36 is retained in an elongated counterbore 38 in plate 10 such that die block 36 may be adjustably positioned in a direction traveled by punch 14. Seated between base 44 of counterbore 38 and lower surface 46 of die block 36 is an elastic die cushion 48 for supporting die block 36. The die block assembly, comprised of die block 36 and die cushion 48, is retained in position in counterbore 38 by a cover plate 62. Cover plate 62 is retained by screws 64 which readily fasten cover plate 62 to plate 10.

Several factors determine the cross sectional area about which clips 22 are applied and hence, the adequacy of attachment of clips 22 about gathered material 32. For example there may be variations in fixed stroke punch travel due to component tolerances in plural clipper mechanisms. Variations in cross sectional area about which clip 22 is applied may result from bulk variations in gathered material 32, employment of different weight gathered materials 32 and/or the inclusion of fastening strap 50 with gathered material 32 prior to clipping.

In the preferred embodiment of the present invention, the die block assembly is initially positioned to ensure that clip 22 is securely applied about a cross sectional area representative of the smallest diameter to be encountered by the clipper mechanism without imparting undue pressure to gathered material 32.

In operation, punch 14 drives clip 22 into active surface 34 of die block 36 to form clip 22 about the cross sectional area of gathered material 32. Pressure exerted on die block 36 and die cushion 48 by punch 14 displaces die block 36 along the direction of travel of punch 14. Die cushion 48 is undersized in the lateral direction and thus may expand into cavities 54 and 56 within counterbore 38 upon compression. The relationship between the pressure applied by punch 14 and the displacement of die block 36 is primarily a function of the elastic material properties of die cushion 48, the compressibility of gathered material 32 and the mechanical properties of clip 22. The improved die block assembly compensates for an incremental increase in cross sectional area of gathered material 32 by allowing displacement of die block 36 an incremental distance proportional to the incremental increase in cross sectional area.

In the preferred embodiment, gathered material 32 may be a fibrous casing material, a plastic film or a laminated flexible film whose thickness is in the range of 2 to 10 mils. The diameter of gathered material 32 prior to clipping is in the range of about 0.150 to 0.500 inches. Applicant has found that the cumulative effect of the factors that determine the ultimate cross sectional area bound by clip 22 are no more than about 0.060 inches greater than the smallest diameter of gathered material 32 encountered by the clipper mechanism. A polyurethane die cushion with a thickness in the range of 0.150 to 0.750 inches and a hardness in the range of about 65A to 100A, as measured on a durometer scale, will ensure that clip 22 is adequately applied to gathered material 32 having the above characteristics without fracturing any of the above mentioned materials.

It is noted that a spring or other shock absorbing mechanisms and materials may be employed rather than elastomeric die cushion 48 for cushioning die block 36. The simplicity of the die block assembly disclosed in the preferred embodiment however, provides a reliable and inexpensive assembly that facilitates an expedient retrofit of die block assemblies in existing single and plural clipper mechanisms. Thus, while there has been set forth a preferred embodiment of the invention, it is to be understood that the invention is to be limited only by the scope of the following claims and their equivalents.

What is claimed is:

1. An improvement in a clip attachment mechanism, the clip attachment mechanism for attaching U-shaped metal clips about gathered casing material, at spaced intervals, to thereby form ends of stuffed products, the stuffed products containing comminuted materials, the metal clips having crowns and depending legs, the mechanism attaching the metal clips in the manner described by forming the legs of the U-shaped clips to encircle the gathered material, the mechanism including a C-shaped die support plate with a channel for receipt of a clip and a die support at a distal end of said channel for holding a die, the die defining a spiral groove for receipt of the legs of the clip, the die directing the deformation of the legs of the clip along the spiral groove to form the legs of the clip about the gathered material, the mechanism further including a punch slidable in the channel for engaging the crown of the clip to drive the clip against the die, and means for operating the punch to reciprocate in the channel, the improvement comprising, in combination with the clip attachment mechanism as described:

elastic die block support means for supporting and maintaining said die block in a relatively fixed position at said distal end of said channel, said die block support means progressively responsive to increased pressure on said die block to allow increased displacement of said die block in the direction of said punch moving toward said die block.

2. The improvement of claim 1 wherein said die block support means comprises a compressible, elastomeric material.

3. The improvement of claim 1 wherein said die block support means comrpises a polyuretahne cushion.

4. The improvement of claim 3 wherein said gathered material is a fibrous casing material, said gathered material having a diameter about at longest of 0.150 inches prior to clipping and said polyurethane cushion is about 0.250 to 0.500–0.100 inches in thickness and has a hardness of about 95A+5A–30A as measured on a durometer scale.

5. The improvement of claim 1 wherein said clipper mechanism is a dual clipper mechanism having first and second separate die blocks with at least one of said die blocks being supported by said elastic support means.

6. The improvement of claim 1 wherein said plate and assembly comprise an upright portion and a base portion, said upright portion defining, at least in part, said channel for receipt of said U-shaped metal clip and said base portion defining a counterbore for receiving said die block and said die block support means wherein said die block support means is interposed between said plate and said die block.

* * * * *